US008616269B2

(12) United States Patent
Besant et al.

(10) Patent No.: US 8,616,269 B2
(45) Date of Patent: Dec. 31, 2013

(54) HEAT EXCHANGER WITH MULTI-PLATE STRUCTURE AND USE THEREOF

(75) Inventors: Tanzi Besant, London (GB); John Coplin, Derby (GB); Albert Demargne, Surrey (GB); Arnold James Stuart Pratt, Derbyshire (GB)

(73) Assignee: Hiflux Limited (GB)

( * ) Notice: Subject to any disclaimer, the term of this patent is extended or adjusted under 35 U.S.C. 154(b) by 1352 days.

(21) Appl. No.: 10/572,300

(22) PCT Filed: Sep. 30, 2004

(86) PCT No.: PCT/GB2004/004164

§ 371 (c)(1),
(2), (4) Date: Dec. 20, 2006

(87) PCT Pub. No.: WO2005/033607

PCT Pub. Date: Apr. 14, 2005

(65) Prior Publication Data

US 2007/0084593 A1 Apr. 19, 2007

(30) Foreign Application Priority Data

Oct. 2, 2003 (GB) ..... 0323093.5
May 19, 2004 (GB) ..... 0411148.0

(51) Int. Cl.
*F28F 1/00* (2006.01)

(52) U.S. Cl.
USPC ..... 165/166; 165/150; 429/434

(58) Field of Classification Search
CPC ..... F28D 9/0031; F28D 9/00333
USPC ..... 429/400; 165/150, 166
See application file for complete search history.

(56) References Cited

U.S. PATENT DOCUMENTS 2,812,618 A 11/1957 Weston
4,771,826 A 9/1988 Grehier et al.
4,898,233 A * 2/1990 Grehier et al. ..... 165/166
5,832,992 A 11/1998 Van Andel (Continued)

FOREIGN PATENT DOCUMENTS

DE 10 025 486 11/2001
EP 714500 1/1999

(Continued)

OTHER PUBLICATIONS

Int'l Search Report, Dec. 28, 2004, Hiflux Limited.

(Continued)

*Primary Examiner* — Zachary Best
(74) *Attorney, Agent, or Firm* — Kaplan Breyer Schwarz & Ottesen, LLP

(57) ABSTRACT

A heat exchanger comprises a plurality of plates (7, 9, 11, 13) each having first (15, 19) and second (17, 21) heat transfer surfaces on reverse sides. The plates are arranged in a stack with spacings between mutually facing heat transfer surfaces of adjacent plates. Alternate spacings in the stack providing respectively, a first fluid path (51, 52) for a first fluid and a second fluid path (57, 59) for a second fluid. The plates are arranged in a plurality of groups, each comprising at least two plates. Pin means are provided in the form of a plurality of groups of pins (23). The pins of each pin group are arranged to bridge plates of a respective plate group.

36 Claims, 11 Drawing Sheets

(56) References Cited

U.S. PATENT DOCUMENTS

| | | | |
|---|---|---|---|
| 5,845,399 | A | 12/1998 | Dewar et al. |
| 6,305,079 | B1 | 10/2001 | Child et al. |
| 2003/0056943 | A1 | 3/2003 | Dessiatoun et al. |

FOREIGN PATENT DOCUMENTS

| | | | |
|---|---|---|---|
| FR | 2 292 945 | | 6/1976 |
| FR | 2292945 | | 6/1976 |
| FR | 2292945 | A * | 7/1976 |
| GB | 1538653 | | 1/1979 |
| GB | 2000268 | | 1/1979 |
| GB | 2122738 | | 1/1984 |
| JP | 2003-41946 | A | 2/2003 |
| WO | WO 2005/033607 | | 4/2005 |

OTHER PUBLICATIONS

Int'l Preliminary Report, Oct. 6, 2005, Hiflux Limited.
Search Report of PCT/GB2004/004164.

* cited by examiner

HEAT EXCHANGER WITH MULTI-PLATE STRUCTURE AND USE THEREOF

FIELD OF THE INVENTION

This present invention relates to a heat exchanger and its use in various industrial applications. Various such applications are set-out in more detail hereinbelow but use in a gas turbine arrangement constitutes one preferred class of embodiments.

BACKGROUND OF THE INVENTION

Gas turbines are often used in distributed electrical power generation and also in transport applications. There are problems in providing appropriate heat exchangers (recuperators) in this and other applications, which operate sufficiently well and also are of appropriate size, cost and performance.

For gas-to-gas heat exchangers, plate and fin or plate and tube arrangements are usually desirable. Conventional plate and tube heat exchangers comprise a structure in which one fluid runs through lengths of tubes which extend through a stack of parallel plates. The second fluid runs between the gaps between the plates.

U.S. Pat. No. 5,845,399 discloses a carbon fibre composite heat exchanger in which carbon fibre filaments run through the plane of parallel laminated carbon fibre plates defining therebetween, a flow path alternately for first and second fluids.

As described in GB-A-2 122 738, a corrosion resistant heat exchanger comprises flow channels separated by partitioning wall plates made of a corrosion resistant material such as of plastics, through which pass heat transfer fins made of ceramics.

Another heat exchanger comprising crenellated plates separating separate flow channels, is described in U.S. Pat. No. 4,771,826.

EP-A-714 500 relates to a heat exchanger comprising heat conducting wires passing through channel separation layers defined by an in-fill region bounded by nylon spacer wires arranged in planes running orthogonal to the direction of the conducting wires.

DE-A-100 25 486 discloses a heat exchanger in which flattened elongate tubes present a plate-like structure in which alternate gaps between "plates" define respective fluid flow paths and the whole structure has pins or rods passing therethrough.

U.S. Pat. No. 6,305,079 describes a heat exchanger with a cellular structure. Each "cell" comprises a pair of plates onto which fin-like structures are bonded to increase heat transfer area. The space between the plates of each cell is bridged by the fin-like structure. Relatively hot and cold flows are directed between alternate plates. The cells are supported at either end by virtue of their ends being formed and bonded into a bellows or concertina-like configuration.

U.S. Pat. No. 2,812,618 discloses a plate and pin arrangement in which pins of non-circular cross-section are arranged in alternating cross-sectional orientation from plate-to-plate, through the heat exchanger. The varying orientation is such the pins are not all co-axial with each other.

The fact remains that plate-and-pin designs and cellular designs have hitherto been severely limited by their inability to withstand prolonged operation at high temperatures (typically above 650° C.), precisely where the benefits of recuperation on gas turbine performance are greatest.

DEFINITION OF THE INVENTION

In the broadest aspect, a heat exchanger according to the present invention is arranged so that the two fluids can flow between alternate gaps between the plates and pin means extending through one or more plates. This form of construction can provide structural support and contribute significantly to heat transfer. The plates are preferably arranged into respective cells each comprising a plurality of plates joined by pins. The structures of heat exchangers according to the various embodiments also enhance the ability to operate at high temperatures and pressures and/or confer other benefits.

A first aspect of the present invention provides a heat exchanger comprising a plurality of plates each having first and second heat transfer surfaces on reverse sides thereof, said plates being arranged in a stack with spacings between mutually facing heat transfer surfaces of adjacent plates, alternate spacings in the stack providing respectively, a first fluid path for a first fluid and a second fluid path for a second fluid, and wherein the plates are arranged in a plurality of groups, each comprising at least two plates, pin means being provided comprising a plurality of groups of pins, the pins of each pin group being arranged to bridge plates of a respective plate group.

A second aspect of the present invention provides a heat exchanger comprising a plurality of stacked pairs of spaced apart plates, the plates in each pair each having a respective mutually facing inner surface defining therebetween, a first fluid path for a first fluid and the plates in each pair each having a respective outer facing surface reverse from said respective inner surface, the outer facing surface of a plate in one pair being spaced apart from and facing an outer facing surface of a plate in an adjacent pair to define therebetween a second fluid path for a second fluid, the plates in a pair being bridged across the first fluid path by a plurality of pins.

A third aspect of the present invention provides a heat exchanger comprising a plurality of plates each having first and second heat transfer surfaces on reverse sides thereof, said plates being arranged in a stack with spacings between mutually facing heat transfer surfaces of adjacent plates, alternate spacings in the stack providing respectively, a first fluid path for a first fluid and a second fluid path for a second fluid, wherein said plates in the stack are arranged in a plurality of groups, pin means being provided comprising a plurality of groups of pins respectively joining and extending through each group of plates.

A fourth aspect of the present invention provides a heat exchanger comprising a plurality of stacked pairs of spaced apart plates, the plates in each pair each having a respective mutually facing inner surface defining therebetween, a first fluid path for a first fluid and the plates in each pair each having a respective outer facing surface reverse from said respective inner surface, the outer facing surface of a plate in one pair being spaced apart from and facing an outer facing surface of a plate in an adjacent pair to define therebetween a second fluid path for a second fluid, the plates in a pair being bridged across the first fluid path by a plurality of pins extending through and beyond their outer surfaces into the second fluid path.

In a fifth aspect, the present invention provides a heat exchanger comprising a plurality of plates each having first and second heat transfer surfaces on reverse sides thereof, said plates being arranged in a stack with spacings between mutually facing heat transfer surfaces of adjacent plates, alternate spacings in the stack providing respectively, a first fluid path for a first fluid and a second fluid path for a second fluid, wherein pin means are provided extending through at least one plate in the stack.

In a sixth aspect, the present invention provides a heat exchanger comprising a plurality of stacked pairs of spaced apart plates, the plates in each pair each having a respective mutually facing inner surface defining therebetween, a first fluid path for a first fluid and the plates in each pair each having a respective outer facing surface reverse from said respective inner surface, the outer facing surface of a plate in one pair being spaced apart from and facing an outer facing surface of a plate in an adjacent pair to define therebetween a second fluid path for a second fluid, the plates in a pair being bridged across the first fluid path by a plurality of pins extending through and beyond their outer surfaces into the second fluid path.

DETAILED DESCRIPTION OF THE INVENTION

Flow directions of the first and second fluids, respectively between alternate sets of plates in the stack may be in the same direction as each other, or preferably counter-flow, or even orthogonal or at any other mutual angle. The term "fluid" as used herein encompasses both liquids and gases and independently, the first and second fluids may be either.

Although it is preferred for substantially all plates in the heat exchanger to have the configuration (eg with regard to the pin means) as defined in the definition of any aspect of the present invention, optionally, the heat exchanger may also contain plates not fitting this definition and/or other structures, especially other heat exchange structures.

The use of pins bridging plates allows an arrangement of heat transfer surfaces which enables the use of thicker, high-temperature materials manufactured in such a way as to deliver the robustness and reliability that is lacking in current recuperators. The penalty of using extra material is mitigated by the enhanced heat transfer which occurs not only across the plates but also through the pins. In this form, the heat exchanger is capable of sustained high temperature operation.

A heat exchanger according to the present invention preferably comprises at least 2, eg. 10 or more groups of plates joined by pins. There is no upper limit to the number of the plates members as a whole but depending on application, this could go up to 100's or 1,000's, eg. 10,000. However units having from 60 to 600 plates are typical. There is also no upper limit to the total number of plate groups.

Within any one group, the pin means may comprise pins extending from one heat transfer surface of at least one plate (but preferably all the plates in that group) which are substantially in-line with those extending from the other heat transfer surface at that plate. Altematively, the pins extending from the one heat transfer surface may be radially staggered (ie offset) with respect to those extending from the other heat transfer surface. The latter arrangement can be advantageous for the manufacture of the heat exchanger, as will be explained in more detail hereinbelow.

It is advantageous for the pin means also to comprise outer pins extending from the outermost heat transfer surfaces of at least one group of plates, said further pins terminating in respective pin free ends. Preferably, a gap is provided between the ends of the pins from one group and the ends of the pins from an adjacent group. Preferably, the respective fluids flowing between alternate gaps between plates is such that for those gaps in which the ends of such pin segments are located, the fluid pressure is lower than in the alternate spacings between plates through which the pin members extend in unbroken manner.

Each plate group may consist of two plates but groups of more than two plates may be joined by individual pin members, preferably sets of any even numbers of plates such as four, six, eight or more. Again, it is preferred for a gap to be arranged between ends of pins in one such group of joined plates and the ends of pins extending through an adjacent group. When the pins are radially offset or staggered between rows, most preferably, pins which have mutually facing ends separated by a gap are nevertheless, substantially in-line with each other. However, at least some pins with mutually facing ends could be offset (staggered).

The size of any such gap between pin ends is preferably from 1% to 50%, more preferably from 2% to 20% of the size of the gap between the plates through which those pin segments extend to terminate in the respective ends. Preferably, the pins are solid but a hollow or honeycomb structure would also be possible. Preferably also, in cross-section, the pins are cylindrical but other cross-sectional shapes such as elliptical, polygonal or aerofoil shapes are also possible and in general, the invention is not limited to any particular shape. Further, it is not absolutely necessary for all pins to have the same cross-sectional shape and/or the same cross-sectional diameter. For example, the pin diameter may vary locally to accommodate technical and manufacturing constraints, or the pin array could consist of pins of smaller diameter alternating with pins of larger diameter within a single row.

Nor is it indeed necessary for the pins to be purely cylindrical along their axis. The pin cross-section may vary in size and shape along its axis, eg tapered or circular at the ends but having an aerofoil shape in the middle. One form of tapering which is possible is tapering so as to be wider at the ends, narrowing towards the middle.

To enhance aerodynamic flow around the pins and/or their heat transfer capacity, some or all of the pins may exhibit irregularities such as protrusions or ribs (eg circular or helical ribs) or may otherwise have their surface area increased by roughening, eg with application of an appropriate coating such as that applied by vapour aluminizing, or by other surface treatment such as blasting.

The pins are preferably arranged in rows normal to the direction of fluid flow but the pins in alternate rows are preferably mutually staggered relative to those in the corresponding adjacent row(s) so that when viewed from above, the ends of the pins appear to be positioned at the apexes of a triangle (eg a substantially equilateral triangle) with one side substantially normal to the flow direction. The ratio of the pitch of the side normal (or most nearly normal) to the flow to that of the axial pitch of the pins can vary, for example, from 0.4 to 4, more preferably from 1 to 1.2, which corresponds to pins arranged in a preferably substantially equilateral array with one side preferably substantially normal to the flow. However, another configuration is also possible whereby the "side" of this nominal triangle is at an oblique angle relative to the direction of flow.

In the case of cylindrical pins, preferably their mean cross-sectional diameter is from 0.1 mm to 10 mm, more preferably from 0.5 mm to 3 mm. The mean plate thickness is preferably from 0.1 mm to 3 mm.

The spacing between adjacent plates in any one group is preferably substantially constant over the area of the plates and preferably also, from one inter-plate spacing to the next. However, these spacings may vary in some instances. Preferably also, the spacing between plates in a group is substantially the same as that in one or more, preferably all, other groups. The spacing between different pairings of plates does not necessarily have to be the same. The spacing between adjacent plates containing pin ends is preferably from 0.1 to 100 times the mean cross-sectional diameter, more preferably from 1 to 10 times. The spacing between plates which are completely bridged by individual pins or pin members is preferably from 0.1 to 100 times the mean cross-sectional diameter, more preferably from 1 to 10 times.

The plates are preferably substantially flat but may be curved across part or substantially all of their major surfaces. The plates may also be arranged in radial fashion. In that case, preferably they are curved in an involute fashion to keep spacings between adjacent plates substantially constant. Flow may be radial and/or axial respectively for the two fluids.

Preferably, the ratio of the mean spacing between plates defining the first fluid path in a central region of the exchanger to the mean spacing between plates defining the second fluid path in the same region is from 1:100 to 100:1, preferably from 1:10 to 10:1.

Generally speaking, inflow and outflow of the relatively hot and relatively cold fluids is conducted through a respective main ducting means. Respective transition members are provided so that these can communicate with the relevant ends of the first or second fluid flow paths within the body of the heat exchanger. In one class of embodiments, examples of which are hereinafter described, at one or other or both ends of the heat exchanger but preferably at least at the end at which outflow of the relatively lower pressure fluid occurs, the edges of the plates generally parallel to the direction of flow in the main body of the heat exchanger taper inwardly (i.e. so that the plates reduce in width; this width corresponds to the "height" of the heat exchanger along the z axis according to the definition hereinbelow). The higher pressure gas is then fed in through a header tube whilst the outflow of the lower pressure fluid is captured in a manifold surrounding the header tube and its associated feeder.

The most preferred cross-sectional shape of plate is generally or substantially rectangular. However, other shapes are possible. Preferably though, all or most of the plates have substantially the same shape. Preferably, they are of substantially uniform thickness.

As indicated above, in one preferred class of embodiments, the width across the plates in a direction approximate or substantially orthogonal to the direction of flow of at least one of the first and second fluids, progressively narrows in a respective region approaching inflow of the first fluid and/or of the second fluid.

Preferably also, inflow and/or outflow of one of the first and second fluids is directed through respective tube means passing through the stack of plates and provided with at least one opening into the respective first fluid path and/or second fluid path. In this kind of arrangement, preferably also inflow and/or outflow of said other of the first and second fluids is directed within a respective manifold wall at least partially surrounding the respective tube means.

Substantially the same arrangement is preferred at both ends of the heat exchanger, optionally with different diameter header tubes. It is also possible for the feeder arrangement at either end of the device to include more than one header tube and indeed, it is also possible for one end to have a different number of such tubes from the other.

It is convenient to fabricate the heat exchanger as a modular arrangement wherein it is manufactured in the form of modules or units, each comprising a fraction of the total number of plates, with appropriate ducting to lead the two fluid streams into and out of each module. This allows flexibility in configuring a total size of heat exchanger to a particular application requirement. It is also advantageous from the maintenance point of view. Such a modular arrangement may simply comprise a casing in which the modules are stacked. In the case of a gas turbine, such modules could be arranged circumferentially relative to the turbine shaft.

In this specification, unless specifically indicated to the contrary, the following definitions will be used. In the case of a square or rectangular block, the dimension along the spacings between plates in the direction of flow will be termed the length, or x axis. The dimension through the cross section of the plates perpendicular to their heat transfer surfaces will be termed the width, or y axis. The dimension through the spacings between plates (and generally perpendicular to the direction of flow of the fluids in the most preferred embodiments) will be termed the height, or z axis. For convenience, where appropriate, the concepts of length, width and height will be applied to the individual channel members as well as to the total heat exchanger matrix.

In the case of a cylindrical arrangement, if the longitudinal extent of the channel members runs parallel to the axis of symmetry of the cylinder, the dimension is the z axis, the radial direction, the r axis and the angular position, θ.

In the broadest sense, the plates and/or pins may respectively be made from any of metallic, ceramic or composite materials. More specifically the plates and/or pins may be fabricated from high temperature alloys, for example of the type commonly used for fabrication of turbine blades. Alternatively, high temperature ceramics may be used. For less demanding pressure and temperature applications, the plates and pins may be fabricated from high-temperature steels. The pins may be fabricated from the same material as the plates. However, individual pins may be made of different pin materials than the material(s) of other pins, progressively along the direction of fluid flow, eg nickel alloy at one end and stainless steel at the other. This has a cost advantage in that relatively expensive materials need only be used for pins exposed to the most stressful conditions during operation. The material of the pins may be of progressively graded composition or comprise discrete groups of different composition.

Depending on the material in question the method of manufacture may be sheet metal fabrication or extrusion, welding (eg laser welding) photo chemi-etching, casting or superplastic forming with diffusion bonding. The latter is more suitable for intended use at intermediate or high temperatures. Alternatively, the pin and plate arrangement may be manufactured using sintering onto an appropriately formed substrate to create a ceramic structure. Construction from a composite such as a carbon fibre composite is also possible.

With techniques such as welding, the pin means may extend through the plate or plates by physically protruding through holes formed therein. With techniques such as photo chemi-etching, the pins may be formed integrally with the plate or plates. The techniques giving rise to one or other such structure will be well known to persons skilled in the art. It is also possible for a heat exchanger according to the present invention to contain pin means respectively in both forms.

Pins of the pin means may also be formed "integrally" with a plate in the sense that they only extend from one surface thereof but are welded or brazed at at least one end to a heat transfer surface of a plate. In a variant of that technique, one end of each pin can be inserted in a respective hole in each plate to be sbstantially flush with a surface thereof and then welded or brazed in place. In these techniques, welding or brazing can be applied to either or both place surfaces.

Thus, for example, the joining of the pins to the plate or plates and sealing of one fluid from the other can be achieved by means of laser welding. Alternatively, a coating such as mentioned above (eg vapour aluminizing) may also be used to bond the pins to the plates and seal the two fluids from each other.

A seventh aspect of the present invention provides a method for manufacturing a heat exchanger according to the present invention, the method comprising providing one or more workpieces and forming the plates and pin means integrally from said workpiece or workpieces.

In the case of radially staggered pins respectively extending from opposing surfaces of a plate, this is especially suited to "Integral" formation of pins by welding or brazing. Brazing is normally only possible on an exposed plate surface not rendered inaccessible by an adjacent plate. The pins can be welded to one or both surfaces of a first plate and then a second adjacent such plate can be placed against the free ends of pins of the first plate and eg welded from the reverse side. The reverse side welding is made possible because the pins are not in-line from one side of the plate, relative to the other. The alternative technique of brazing is possible when the pins are inserted at one end thereof into holes in the plates so as to be flush with the remote side. In a variant of this technique, when plates are brought together, some of the pins (eg half of them) may be pre-attached to one plate and some to the other. Welding or brazing is then performed on those sides of the plates which are reverse to the bridged sides.

An eighth aspect of the present invention provides a method for manufacturing a heat exchanger according to the present invention, the method comprising providing a plurality of plates, forming holes in said plates, inserting respective pin means into or through the holes and bonding the pin means in place at at least one point of entry into or through the holes.

Regarding the eighth aspect of the present invention, a preferred bonding technique is welding, in particular laser welding. This is because the weld is then of high integrity and is capable of sealing the two fluids from one another. The process also leads to the formation of asperities at regular or irregular intervals around the circumference of the pin(s) in the vicinity of the weld. These asperities are beneficial to heat transfer.

It should be noted that other features which are mentioned as preferred or optional for a heat exchanger according to one aspect of the present invention but are not included in the definition of any other aspect of the invention, may also be incorporated in a heat exchanger according to that other aspect of the invention.

The heat exchanger of any aspect of the present invention is especially suited for use with a power producing apparatus. The power producing apparatus may comprise a gas turbine. In fact, an especially preferred embodiment of the present invention is a recuperator for a gas turbine.

A recuperator uses hot turbine exhaust gas to preheat compressor delivery air prior to entry into the combustor, thus reducing the amount of fuel required to achieve the high turbine entry temperatures needed for efficiency. FIG. 1 of the accompanying drawings shows a recuperated gas turbine which is used to drive a generator for production of electricity.

A compressor 1A, a turbine 3A and a generator 5A are arranged on a common shaft 7A. In the conventional manner, the turbine 3A drives the compressor 1A and generator 5A. The compressor 1A comprises cold intake air which is passed through a recuperator 9A and then, to a combustor 11A, the output of which drives the turbine 3A. This defines a cold path 13A through the recuperator. The exhaust is of the turbine 3A is directed through the hot path 17A of the recuperator to heat compressed air in the cold path 13A and then exits through final exhaust 19A. As well as powers the compressor 1A, revolution of the shaft 7A also turns the generator 5A to produce electricity.

The performance of recuperators is quantified primarily in terms of heat exchange effectiveness and the associated pressure loss. The effectiveness of a recuperator is a measure of the percentage of heat extracted from the hot exhaust gas and transferred into the cooler air from the compressor. A good recuperator should have an effectiveness of over 75%, preferably about 90%. Pressure loss in the recuperator must be kept low, as it tends to reduce the expansion ratio through the turbine, which in turn is detrimental to the power output. Pressure losses should be below 10%, ideally below 5%.

The presence of a recuperator greatly enhances the efficiency of the type of small gas turbines that are used for distributed power generation. Typically, current unrecuperated microturbines operate at efficiencies of under 20% compared to around 30% or more for the recuperated cycle. Waste heat in the exhaust from the recuperator can be used to provide domestic heating (combined heat and power) which effectively further improves the efficiency for the end user. However, significant improvements in overall efficiency require hotter turbine operating temperatures and thus hotter turbine exhaust temperatures than current recuperators can handle.

Alternatively the heat exchanger may be applied to a turbocharger or a super-charger of a reciprocating engine power producer. The heat exchanger may be used to cool air, and desirably after compression of the air in the turbocharger or super-charger, before the air enters the reciprocating power producer.

In an alternative embodiment the invention provides a boiler with a heat transfer mechanism in the form of a heat exchanger apparatus according to the present invention.

Another power source where a heat exchanger according to the present invention may find application is a fuel cell. For example, the heat from a cell that runs at elevated temperature may be used to preheat the air and fuel entering the cell. This minimises the heat that has to be provided by other means to bring the fuel cell up to its operating temperature.

In a further embodiment of the present invention heat exchanger apparatus according to the invention is used to preheat gas, prior to expansion of the gas in a gas expander. High pressure gas is sometimes used to drive a turbine driven electrical power generator. Preheating the gas prior to expansion increases the power output and may prevent the formation of ice particles in the turbine expander.

The present invention may also be claimed in terms of a heat exchanger according to the present invention connected to a supply of the respective first and second fluids, either of which may be liquid or gas and either may be hotter than the other. However, especially preferred is when the first fluid is a hot gas and the second fluid is a cold gas.

BRIEF DESCRIPTION OF THE DRAWINGS

The present invention will now be better described in the following description of preference embodiments and with reference to the accompanying drawings, in which.

DESCRIPTION OF PREFERRED EMBODIMENTS

In many embodiments described hereinbelow, only two groups of plates are shown for convenience. However, it should be understood that usually, in practice, there will be several such like groups.

Figure 2:
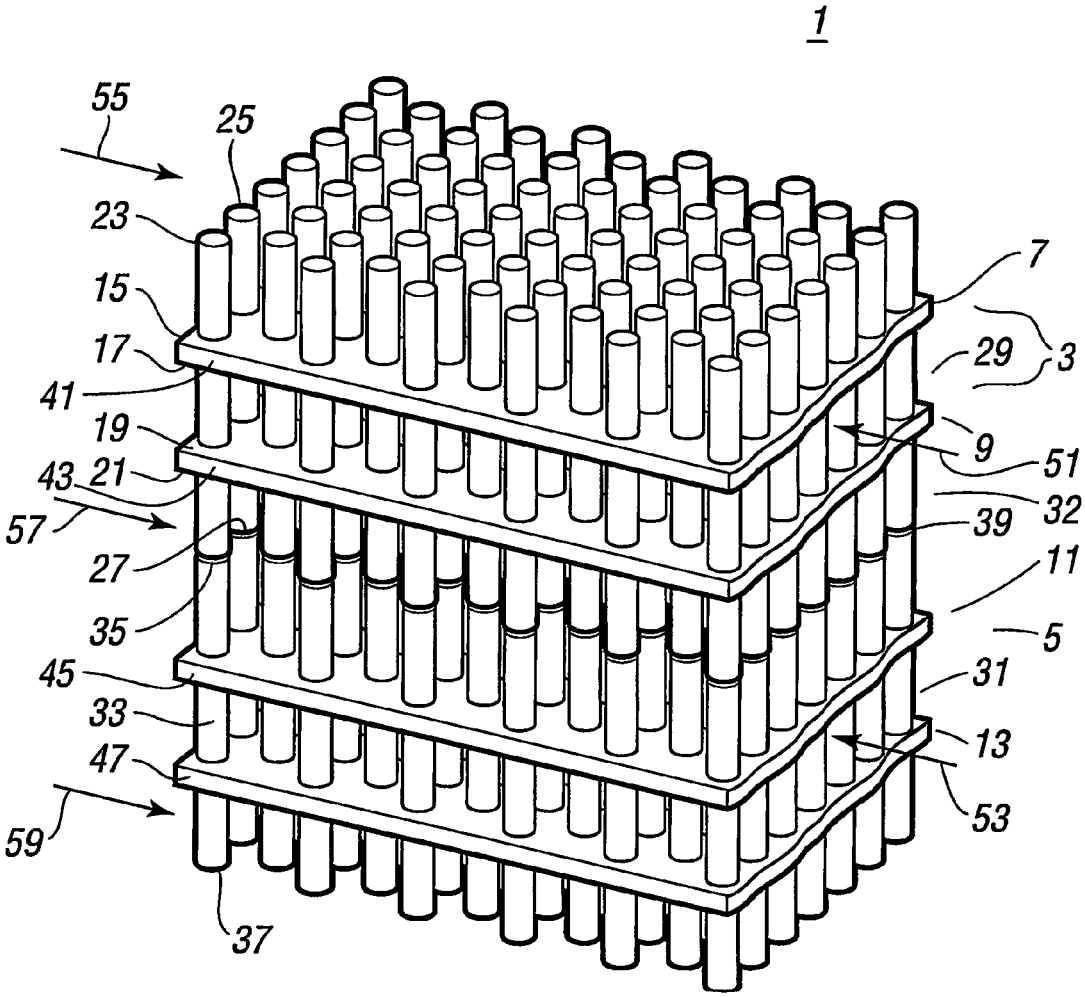
FIG. 2 shows in perspective view, part of a core of a recuperator according to a first embodiment of the present invention.

FIG. 2 of the accompanying drawings shows a perspective view of part of a core 1 of a heat exchanger according to a first embodiment of the present invention. The core comprises a plurality of stacked pairs of plates each joined by pins protruding therethrough. As shown in FIG. 2, part of the stack comprises two pairs 3, 5 of plates. The first pair 3, shown uppermost in the drawing, comprises an upper plate 7 and a lower plate 9. The pair 5 of plates below, also comprises an upper plate 11 and a lower plate 13.

All of the plates in the core are substantially flat and are arranged spaced apart from each other with their major flat surfaces mutually spaced apart in parallel fashion. Thus, plate 7 of the upper pair 3 has an upper flat surface 15 and a lower flat surface 17. The lower plate 9 in the upper pair 3 has an upper surface 19 and a lower surface 21. The lower surface 17 of the upper plate 7 faces inwardly to the upper surface 19 of the lower plate 9. On the other hand, the upper surface 15 of the upper plate 7 faces outwardly from the pair, as does the lower surface 21 of the lower plate 9.

The upper pair 3 of plate 7, 9, are joined by a plurality of substantially cylindrical solid pins 23 etc. which pass through the plates 7, 9, perpendicular to their upper and lower surfaces 15, 17 and 19, 21 respectively. The pins 23 etc. terminate in upper ends 25 etc. above the upper surface 15 of the upper plate 7 of the upper pair 3.

Similarly, the pins 23 etc. terminate at lower ends 27 etc. below the lower surface 21 of the lower plate 9 of the upper pair 3. The upper ends 25 etc. of the pins are all substantially flat and all substantially parallel with each other. Similarly, the lower ends 27 etc. of the pins are also substantially flat and substantially parallel to each other. The common planes of the upper ends 25 and lower ends 27 respectively, are also substantially parallel with the major flat surfaces 15, 17, 19. 21 of the plates.

The pins extend through holes in the plates and are welded thereto, thus keeping the plates apart. In this way, respective spaces 29, 31 are defined between the pairs of plates 7, 9 and 11, 13. A space 32 is also defined between the lower plate 9 of the upper pair and the upper plate 11 of the lower pair.

The lower pair 5 of plates 11, 13 are likewise joined by a plurality of pins 33 etc. respectively terminating in upper ends 35 etc. and lower ends 37 etc.. The arrangement of plates and pins in the upper pair 3 and lower pair 5 are substantially identical.

The pairs of plates 3, 5 are positioned such that in the space 32 therebetween, the upper ends 35 etc. of the pins of the lower pair 5 and the lower ends 27 etc. of the upper pair 3, are separated by a small gap 39. The plates 7, 9 of the first upper pair and plates 11, 13 of the lower pair 5 are held in this position by virtue of being fixed at their respective edges 41, 43, 45, 47 being sealably welded to side walls, eg respectively formed of a pair of the same plates (not shown) and by the end edges (not shown) of the plates which are perpendicular to the side edges 41, 43, 45, 47 being attached to a feeder for inflow and outflow of gas. The pins 23 etc. joining the upper pair of plates 3 and the pins 33 etc. joining the lower pair 5 of plates are arranged so as to be substantially coaxial. However, the pins 23 etc may also be positioned relative to the pins 33 etc so that their respective axes are staggered.

In the drawing of FIG. 2, only two pairs 3, 5 of plates are shown. However, in reality, further pairs of plates joined by pins are stacked above and below the respective pairs 3, 5 in substantially like fashion.

The core held within the side walls attached to the side edges 41, 43, 45, 47 and by attachment to respective feeders at their end edges perpendicular to the side edges. Specifically, the edges of the upper and lower plates of each pair are sealed to a respective side wall and the whole unit is loosely held in a casing which closes the gaps between the edges of respective pairs of plates. Thus, the core with feeders effectively constitutes a sealed unit. The spaces 29, 31 etc. between plates of respective pairs provide a flowpath for a first fluid substantially parallel to the side edges 41, 43, 45, 47, respectively denoted by arrows 51, 53 etc. and so on through the stacks. Similarly, a flow of a second fluid or gas is effected in reverse direction through the alternate gaps 32 etc. defined between the outer facing surfaces 15, 21 etc. of adjacent pairs 3, 5 etc.. This flow is denoted by arrows 55, 57, 59 etc.

Figure 1:
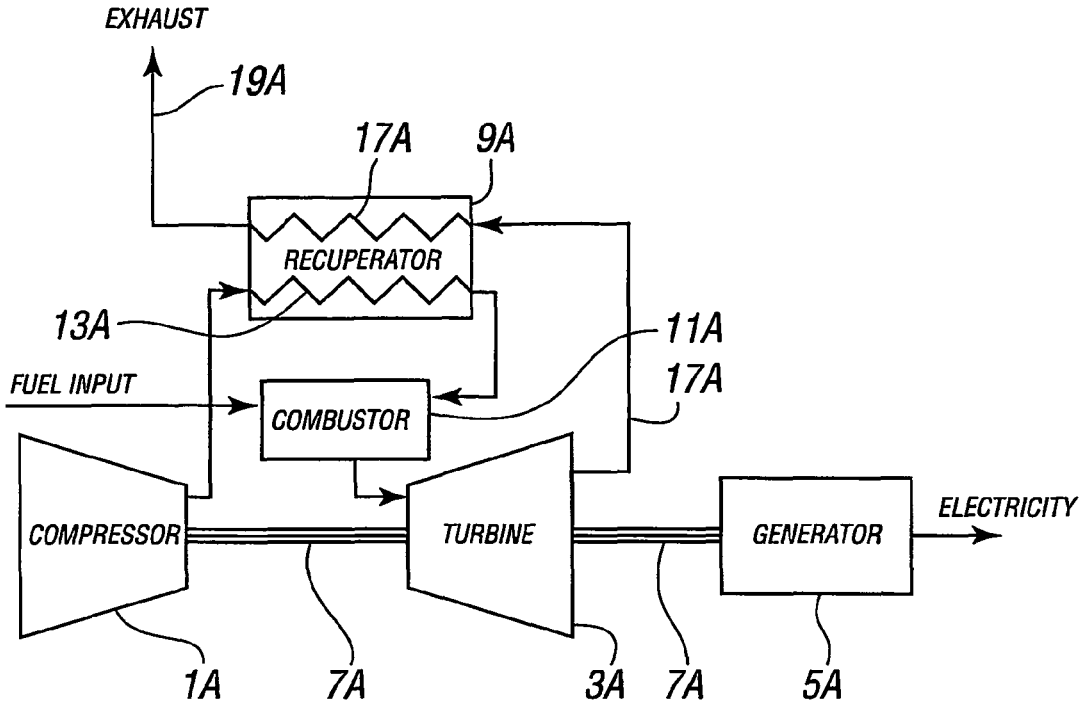
FIG. 1 shows a schematic diagram of use of a recuperator with a conventional gas turbine.
Figures 3A, 3B, 3C:
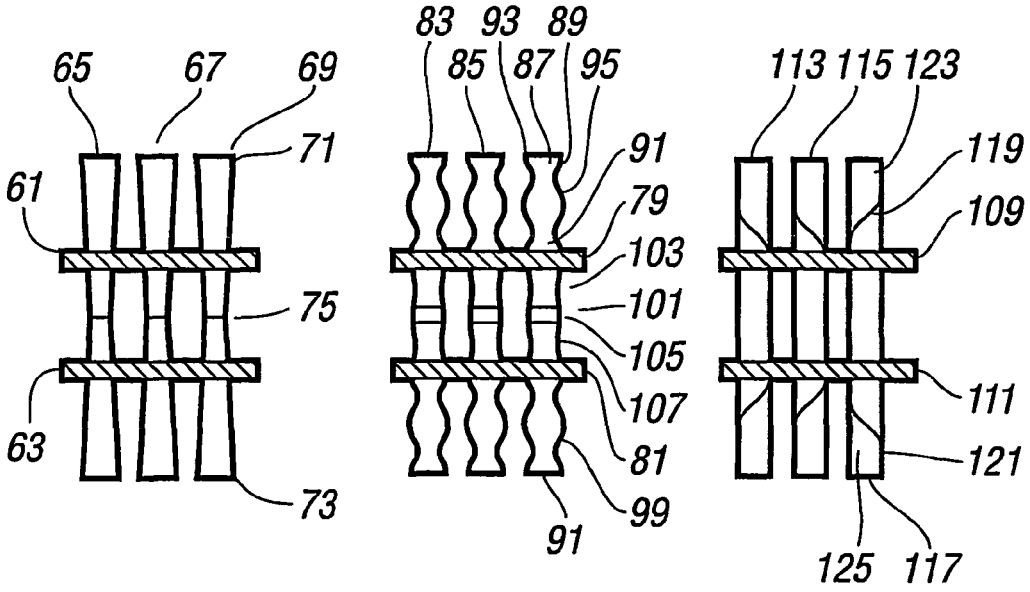
FIGS. 3A-3C show a selection of possible pin geometries of varying cross-section.

FIGS. 3A through 3C show three respective alternative pin geometries. In the embodiment shown in FIG. 2, the pins are substantially uniformily cylindrical. In FIG. 3A, a pair of mutually spaced apart plates 61, 63 are joined by pins 65, 67, 69 etc which protrude therethrough and terminate above the upper plate 61 and the lower plate 63. These pins are substantially identical.

Referring to just one of the pins (69), it is solid and substantially circular in cross-section but has a diameter which is its widest at its upper point 71 which terminates above the upper plate 69 and also at its lowermost extent 73 below the lower plate 63. These two widest ends 71, 73 progressively and linearly taper in diameter towards a narrower middle waisted part 75 substantially midway between the plates 61 and 63.

In FIG. 3B, a pair of mutually spaced apart plates 79, 81 are joined by substantially identical pins 83, 85, 87 etc. Referring specifically to pin 87, this has an upper end 89 and passes through the plates to terminate in a lower end 91. These pins are substantially solid and circular in axial cross-section. From the upper end 89, pin 87 linearly tapers down in diameter for a first third of the distance from the upper end 89 to the plate 79, to define an upper frustoconical section 93. The middle third of this length defining section 95 is curved and bulbous, increasing and then decreasing in axial cross-section (diameter). Finally, a lower section 97 immediately adjacent the upper plate 79 is again frustoconical, outwardly tapering in linear fashion. The lower portion 99 of the same pin, extending below plate 81 has substantially the same profile along its length as the upper part 89 above the upper plate 79.

The middle section 101 of the pin 87, between the plates 79, 81 has circular cross-section which tapers linearly inwardly, moving away from the underside of upper plate 79, in a first region 103 and in a central zone 105 situated approximately midway between the upper plate 79 and lower plate 81, has a substantially constant axial cross-section or diameter. Then, in the final region 107 from the mid region 105, down to the lower plate 81, the axial cross-section (diameter) tapers substantially linearly outwardly.

Turning now to FIG. 3C, between and through mutually spaced apart plates 109, 111, extend substantially cylindrical pins 113, 115, 117. These are substantially the same in that they are solid and have constant cross-sectional diameter. Each of these pins such as pin 117 is provided with a helical rib 119 and 121, respectively on the curved surface of upper region 123 above the upper plate 109 and the lower region 125 below the lower plate 111.

Figure 4:
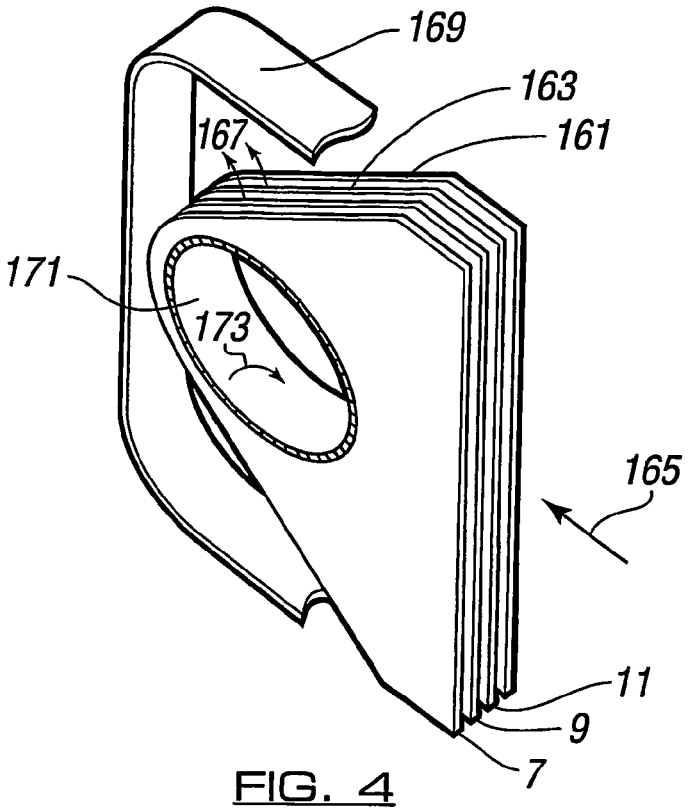
FIG. 4 shows a schematic of one end of a recuperator core of the kind depicted in FIG. 2.

Referring to FIG. 4, there is shown a schematic diagram of one end of a recuperator section such as shown in FIG. 2. NB In FIGS. 4-6, for simplicity the pins are not shown but these drawings are to be interpreted as with the pins in situ. This is not an exact depiction of the structure of this part of the recuperator but is simplified to demonstrate the principle of operation.

At this end, the influx of fluid is that of the fluid which is of a higher pressure than the corresponding fluid in counterflow. The relatively low pressure fluid exits at this end. In the embodiment of FIG. 2, the flow denoted by arrows 51, 53 is of a higher pressure than that denoted by arrows 55, 57, 59 (the latter flowing in the alterative gaps between plates in which mutually facing pin ends are located).

Again, as shown in FIG. 4, the edges 161, 163 etc of the stack of plates also converge in the direction of flow denoted by arrow 165 of the outflowing lower pressure fluid. The outflowing lower pressure fluid exits from the gaps between the plates as denoted by arrows 167 etc to be captured within the space between a manifold wall 169 and the ends of the plates surrounding an inflow header tube 171 which directs higher pressure fluid denoted by arrow 173 via holes (not shown) in the tube wall into the stack of plates to be directed in counterflow between alternate gaps between plates, relative to the oufflowing lower pressure fluid denoted by arrow 165. Thus, in this arrangement, outflowing lower pressure fluid is directed upwardly normal to the major surfaces of the plates in the manifold region bounded by wall 169 and the plate ends whilst the inflowing higher pressure fluid is directed also normal to the major surfaces of the plates before being directed into the core of the recuperator itself.

Figure 5:
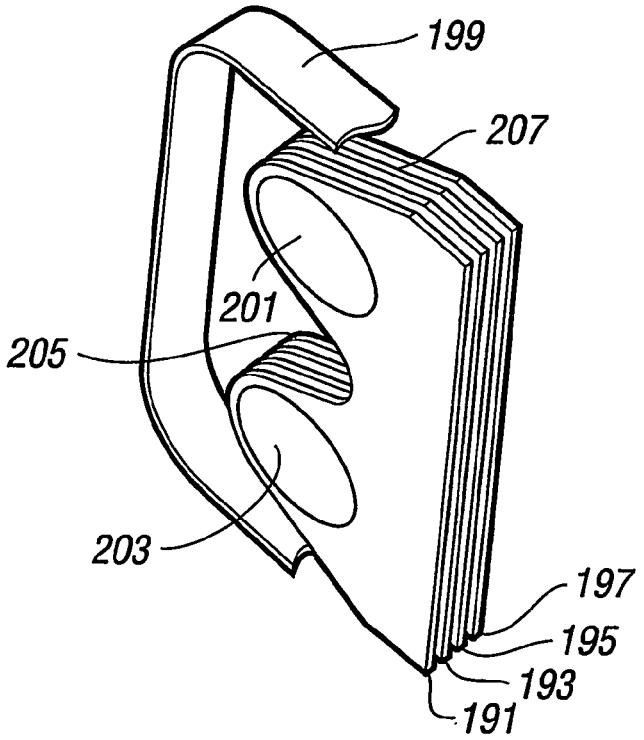
FIG. 5 shows a schematic of an alternative feeder arrangement built around two header tubes instead of a single tube as shown in FIG. 4.

FIG. 5 shows an analogous construction to that shown in FIG. 4. Here the plates are denoted by numerals 191, 193,195 and 197. The manifold region is bounded by a wall denoted 199. Instead of a single inflow header tube 171, the device is provided with a pair of header tubes 201, 203 between which the end of the plates 191 etc is formed in a cut-away region 205. The plates are of reduced width, with edges tapering inwardly in end region 207, entering the region of the manifold wall 199. Holes (not shown) in the header tube walls allow passage of fluid from the tubes into the relevant gaps between plates.

Figure 6:
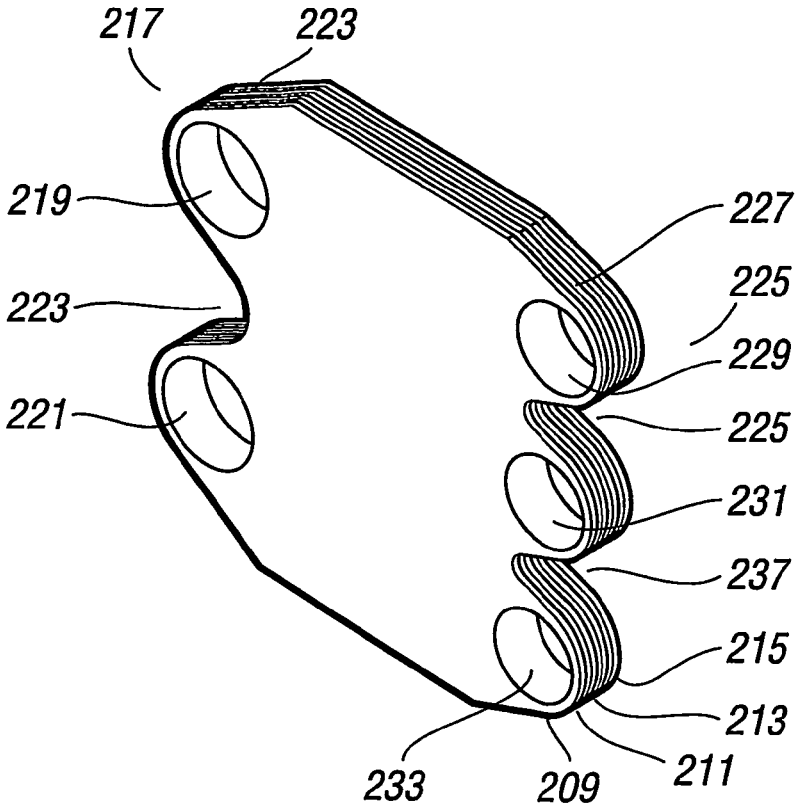
FIG. 6 shows a schematic of a further embodiment of the core and feeders in which the feeder is different at one end relative to the other.

Yet another configuration analogous to that in FIGS. 4 and 5 is shown in FIG. 6. Here, the plates are denoted by numerals 209, 211, 213 and 215. The high pressure inflow end 217 has a pair of header tubes 219, 221, between which is located a cut-away region 223. The ends of the edges of the plates in this end region 223 taper inwardly as in the embodiment shown in FIG. 5.

At the low pressure inflow end 225, the edges of the plates also taper inwardly in a region 227 but three header tubes 229, 231 and 233 are provided for outflow of the high pressure fluid via holes in the tube walls (not shown). These are respectively partially separated by cut-away regions in the plates 235 and 237. In this embodiment, manifold walls at either end are not shown, for simplicity of the drawing.

Figure 7:
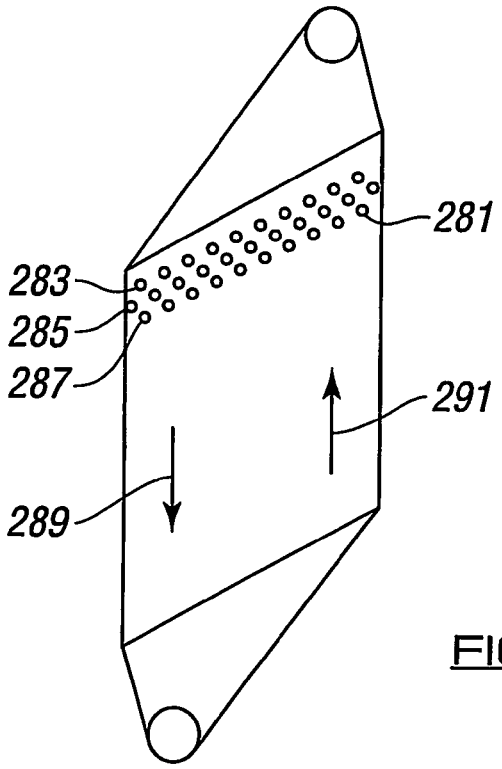
FIG. 7 shows an alternative pin configuration from that shown in FIG. 2.

In FIG. 2, it can be seen that the pins are arranged in staggered rows substantially normal to the direction of fluid flow. However, as depicted in FIG. 7, the pins 281 etc. are arranged in rows 283, 285,287 which are obliquely angled relative to the direction of high pressure and low pressure flow depicted by arrows 289, 291.

Figure 8:
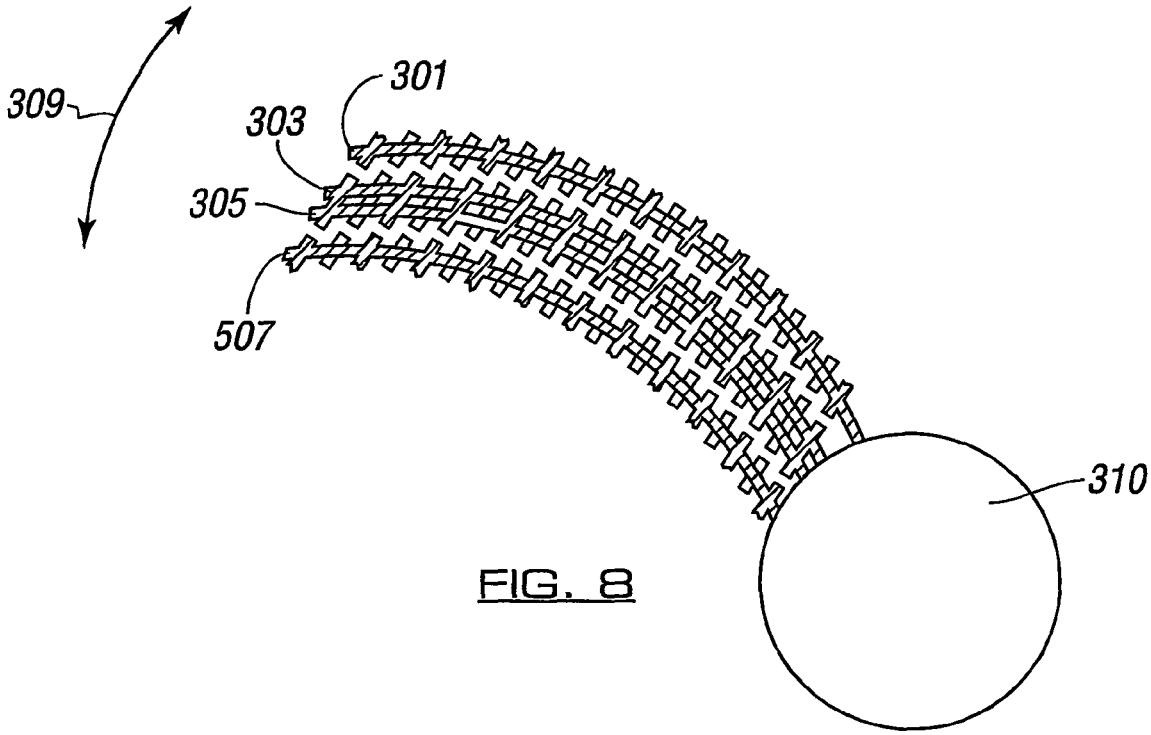
FIG. 8 shows an involute form of plate configuration.

FIG. 8 shows another arrangement whereby instead of being substantially flat, the plates are curved. In this arrangement, when viewed from the edge, the plates 301, 303, 305, 307 are curved and arranged so as to define an involute form when viewed edgewise in this fashion. Only four plates are shown. In reality, a complete cylindrical arrangement of curved plates would be provided. In such a configuration, flow of the respective fluids is into, and out of the plane of paper. In a variant of this embodiment, respective flows may be from an axial header tube (not shown) at the circumference 309 to an axial header tube 310 at the centre and from a manifold at the circumference to a manifold at the centre. In yet another variant of this embodiment, respective flows may be from an axial header at the circumference to a manifold at the centre, and vice versa.

Figure 9A:
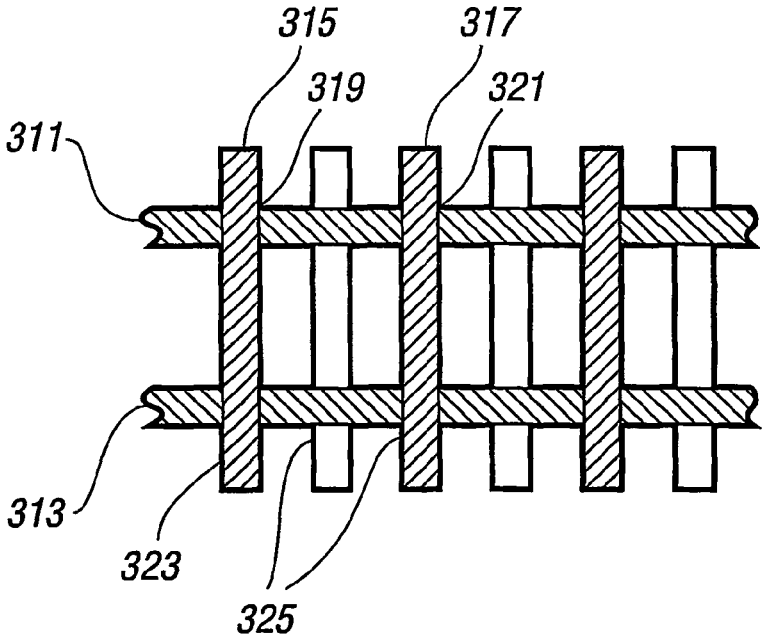
FIGS. 9A and 9B show, respectively, an arrangement of pins passing through plates and of pins extending through plates but formed integrally therewith.

As depicted in FIG. 9A, there is seen a cross-section through parts of a pair of plates denoted by numerals 311, 313, essentially as plates 7, 9 in the recuperator core shown in FIG. 3. In FIG. 9A, these plates 311,-313 have pins 315, 317 etc. passing through holes 319, 321 etc. (upper plate 311) and 323, 325 (lower plate 313). The pins are held in place by continuous or spot welds (not shown) between the pins and the circumference of the holes in the plates.

Figure 9B:
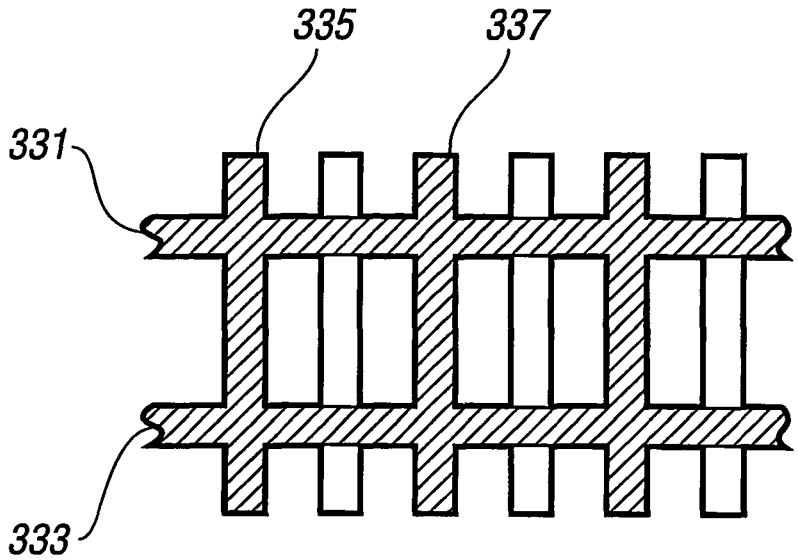

On the other hand, turning to FIG. 9B, a pair of plates 331, 333 have a plurality of pins 335, 337 extending therethrough but formed integrally therewith. Such a form of construction can be achieved by casting.

Figure 10:
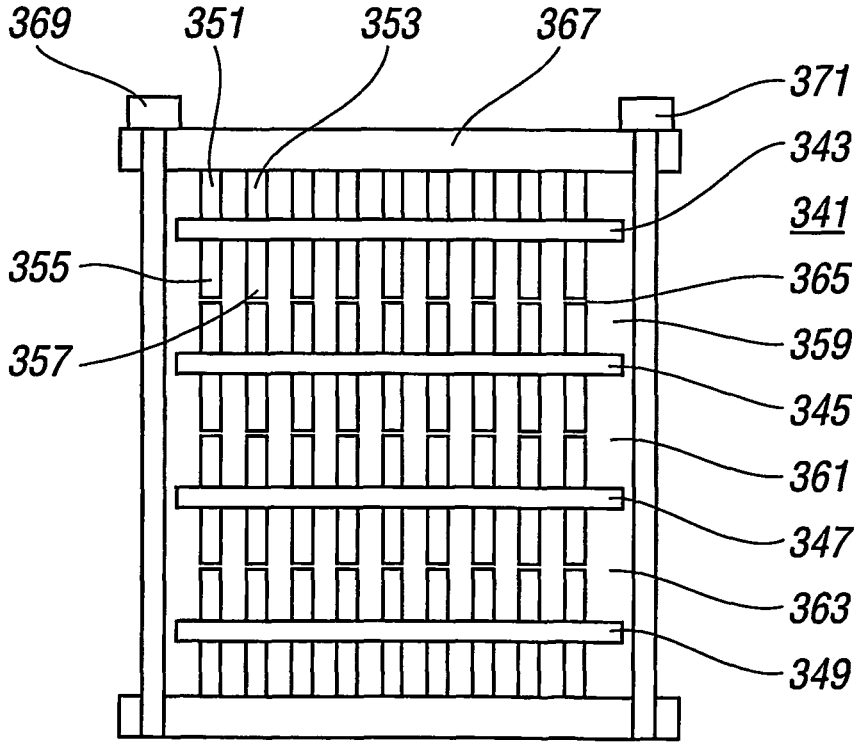
FIG. 10 shows a schematic of a low pressure recuperator according to the present invention.

Turning to FIG. 10, there is shown another arrangement of a recuperator core 341 comprising a plurality of mutually spaced apart plates 343, 345, 347, 349.

A plurality of pins such as 351, 353 etc. passes through the plates such that ends 355, 357 etc. of these pins 351, 353 terminate midway across the gaps 359, 361, 363 between the plates 343 etc. As in the embodiment of FIG. 2, mutually facing pin ends extending above the respective plate(s) below are slightly spaced apart by an air gap such as 365. However, the difference between this arrangement and that shown in FIG. 2, is that each pin, only passes through one respective plate so that one end thereof, faces the corresponding end of a pin extending through the immediately adjacent plate. Such a configuration may be made by photo-chemietching from a solid workpiece and then the resultant plates with half-pins either side can be assembled in a stack simply by holding them together in a yoke 367 by means of comer bolts 369, 371 etc. To adapt such a device for slightly higher pressure operation, it would be possible to insert a continuous pin through the hole stack at intervals, for example so that one pin in every ten per row and per column is continuous and the remainder are discontinuous extending only through a single plate. Altematively, the discontinuous pins could be welded together at intervals, for example so that one in every ten pins forms a continuous joint between the plates.

Figure 11:
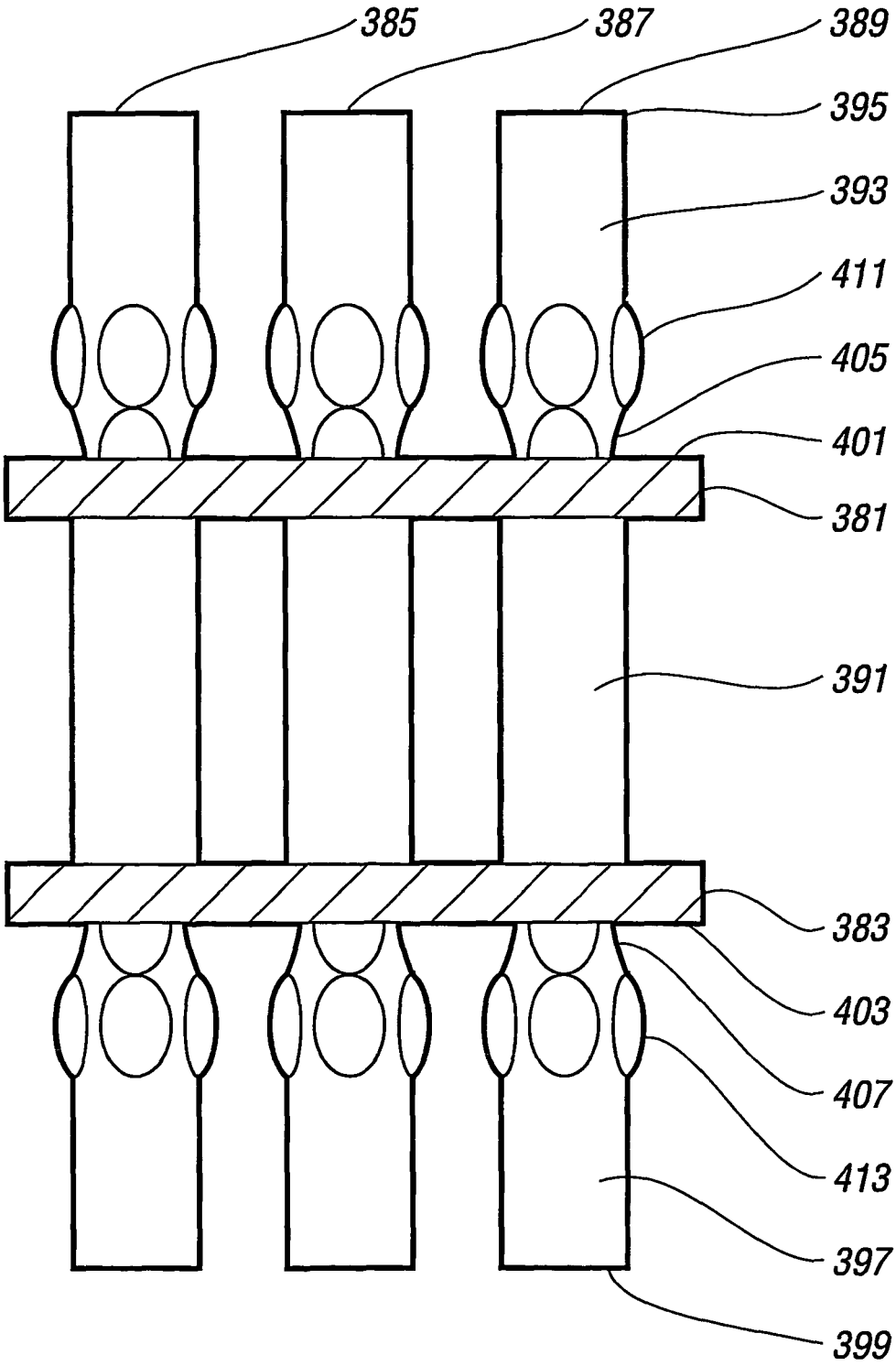
FIG. 11 shows surface features arising from laser welding of pins to plates.

Referring to FIG. 11, there is shown a beneficial effect of laser welding pins to plates. Specifically, FIG. 11 depicts a single pair of plates 381 and 383. These are mutually spaced apart and joined by pins 385, 387, 389. In the real device, there would be a plurality of such pairs of plates and many more pins, as in the other specific embodiments. The pins are substantially the same. For convenience, referring only to one of these pins 389, it comprises a central cylindrical portion 391 between the two plates 381, 383 as well as an upper portion 393 extending above plate 381, to terminate in upper end 395 and a lower portion 397 extending below lower plate 383 to terminate in bottom end 399.

Where the upper end 393 emerges from the upper surface 401 of the upper plate 381, and also where lower end 397 emerges from the bottom surface 403 of the lower plate 383, the pin 389 is spot welded to the respective plate 381, 383. At the point of emergence, the upper end 393 and lower end 397 has a respective region 405, 407 of narrowed diameter. This is caused by the laser welding which more importantly, causes the formation of surface asperities, for example denoted by numerals 411 and 413. These are beneficial to heat transfer.

Figure 12:
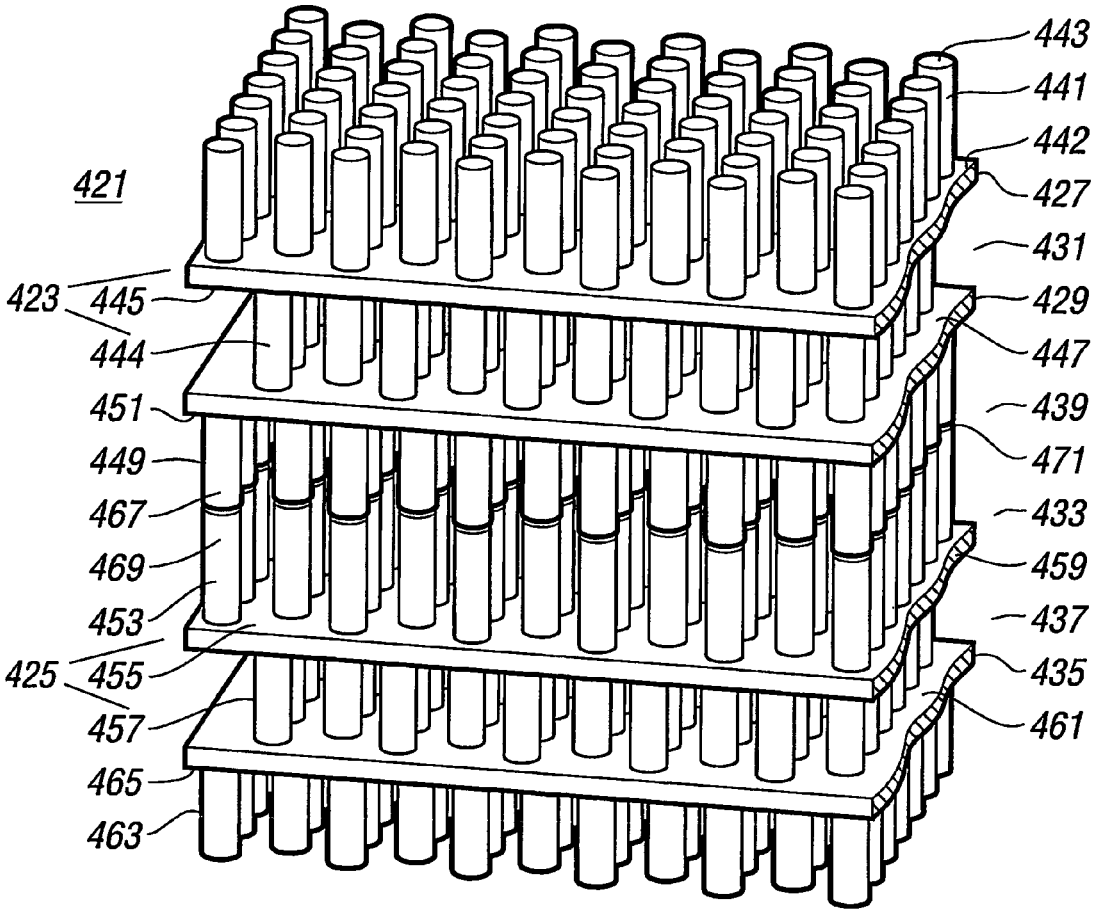
FIG. 12 shows a perspective view of another embodiment of a heat exchanger according to the invention, wherein the pins are offset or staggered between layers.
Figure 13:
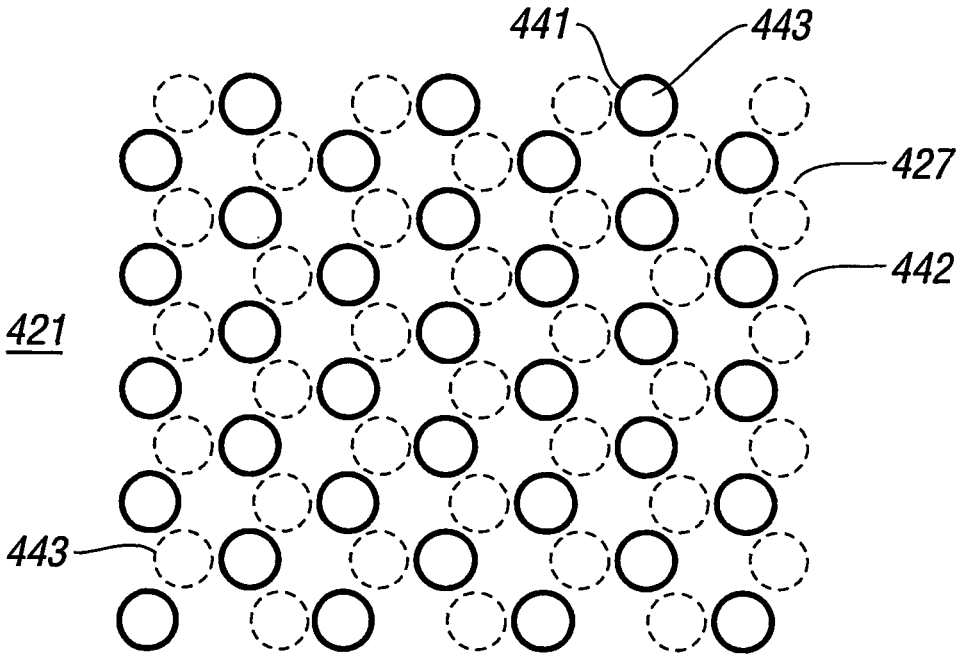
FIG. 13 shows a plan view of the heat exchanger shown in FIG. 12.
Figure 14:
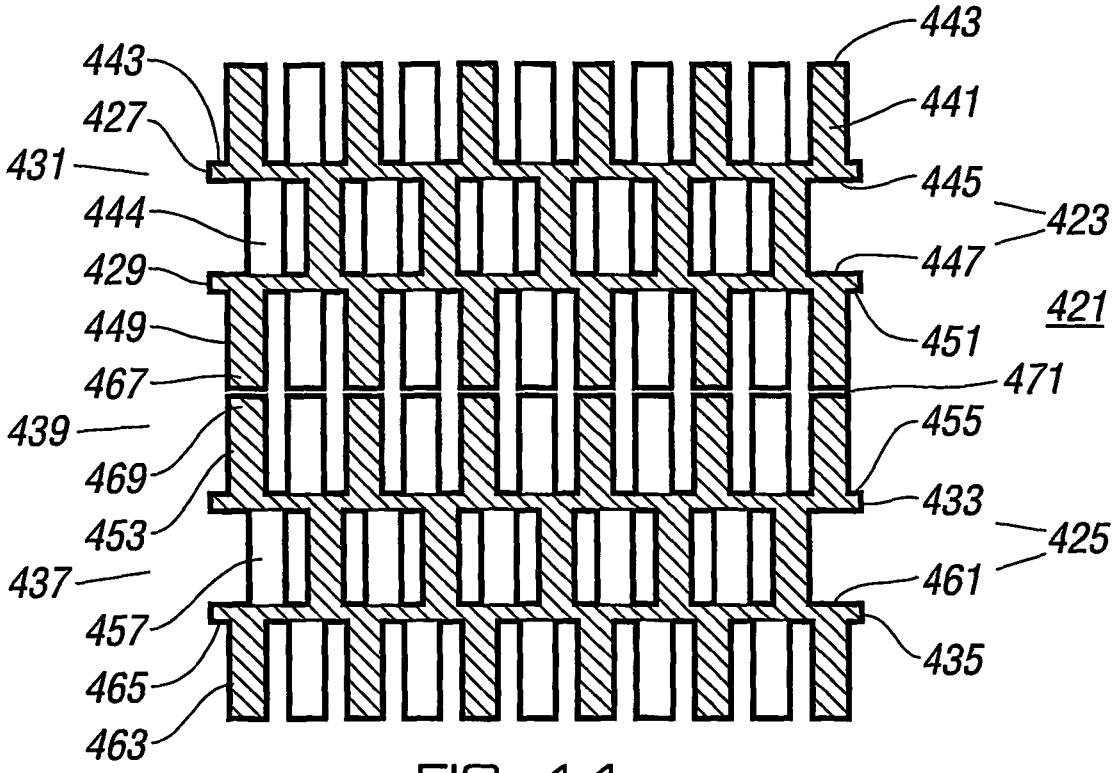
FIG. 14 shows a cross section through the heat exchanger shown in FIGS. 12 and 13.

An embodiment of a heat exchanger 421 according to the invention, in which pins are radially offset or staggered, is shown in FIGS. 12 to 14. The heat exchanger 421 comprises a plurality of pairs of plates. For convenience, only two pairs 423, 425 are shown.

The first pair 423 comprises an upper plate 427 and a lower plate 429 which are mutually parallel and are separated by a gap 431 therebetween The lower pair 425, likewise comprises an upper plate 433 and substantially parallel thereto, a lower plate 435. The plates 433, 435 of the lower pair 425 are also separated by a gap 437. The upper pair 423 is separated from the lower pair 425 by another gap 439, 437 between the upper and lower plate pairs 423,425. The lower plate 429 of the upper pair 423 is also substantially parallel to the upper plate 433 of the lower pair 425. A plurality of pins 441 etc extends upwardly from an upper surface 442 of the upper plate 427 so as to be axially orthogonal thereto. These upwardly extending pins 441 etc terminate in free ends 444 etc. The plates 427, 429 of the upper pair 423 are bridged across the gap 431 by another plurality of pins 443 etc. Thus, the pins 443 etc are connected at one end to the lower surface 445 of the upper plate 427 and the upper surface 447 of the lower plate 429. The pins 443 bridging the plates 427, 429 are radially offset or staggered with respect to the pins 441 etc extending upwardly from the upper surface of the upper plate 427. This can be better seen from FIG. 13, in which the upwardly extending pins 441 etc are shown in solid outline whereas the bridging pins 443 are shown in broken outline. These pins are all substantially cylindrical and the bridging pins 443 are radially offset such that their axis of symmetry is substantially equidistant from the axes of symmetry of the three closest upwardly extending pins 441 etc.

Another plurality of pins 449 etc extends axially orthogonally downwardly from the lower surface 451 of the lower plate 429 of the upper pair 423. These downwardly extending pins 449 etc are also axially offset with respect to the bridging pins 443 but so that their axes of symmetry are in-line with those of the upwardly extending pins 441.

The pin arrangement for the lower plate pair 425 is substantially the same as that for the upper plate pair 423. Another plurality of pins 453 etc extends axially orthogonally upwardly from the upper surface 455 of the upper plate 433 of the lower pair 425. A set of axially offset bridging pins 457 extend axially orthogonally between the lower 459 of the upper plate 433 of the lower pair 425 and the upper surface 461 of the lower plate 435 of the lower pair 425.

Another set of pins 463 etc extends downwardly from the lower surface 465 of the bottom plate 435 of the lower pair 425. These downwardly extending pins 463 are axially offset with respect to the bridging pins 457 but axially in-line with the upper extending pins 453, or of the lower pair of plates 425.

However, the lower ends 467 etc of the downwardly extending pins from the lower plate 429 of the upper pair 423 and the upper free ends 469 of the pins 453 etc which extend upwardly from the upper plate 459 of the lower pair 425, are separated by respective gaps 471 etc. Moreover, the downwardly extending pins 449 etc from the upper pair 423 and the upwardly extending pins 453 etc from the lower pair 425 are axially substantially in-line. Thus, it can be regarded that the pins in alternate gaps of plates are mutually axially staggered except that the pins in every other gap are effectively split so as to define respective gaps between free pin ends.

The fluid flows are counterflow between successive plates in the manner described with respect to, and depicted in, FIG. 2.

Figure 15:
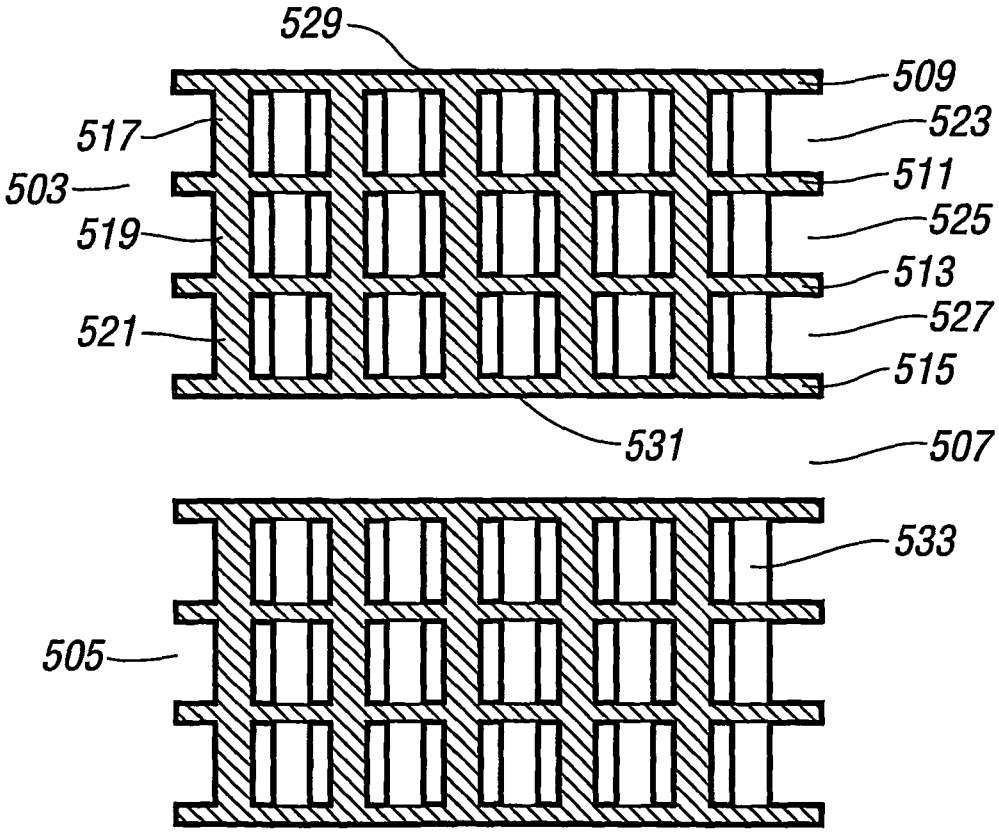
FIG. 15 shows a cross section through an embodiment of a heat exchanger according to the invention, having four plates per group and in-line pins.
Figure 16:
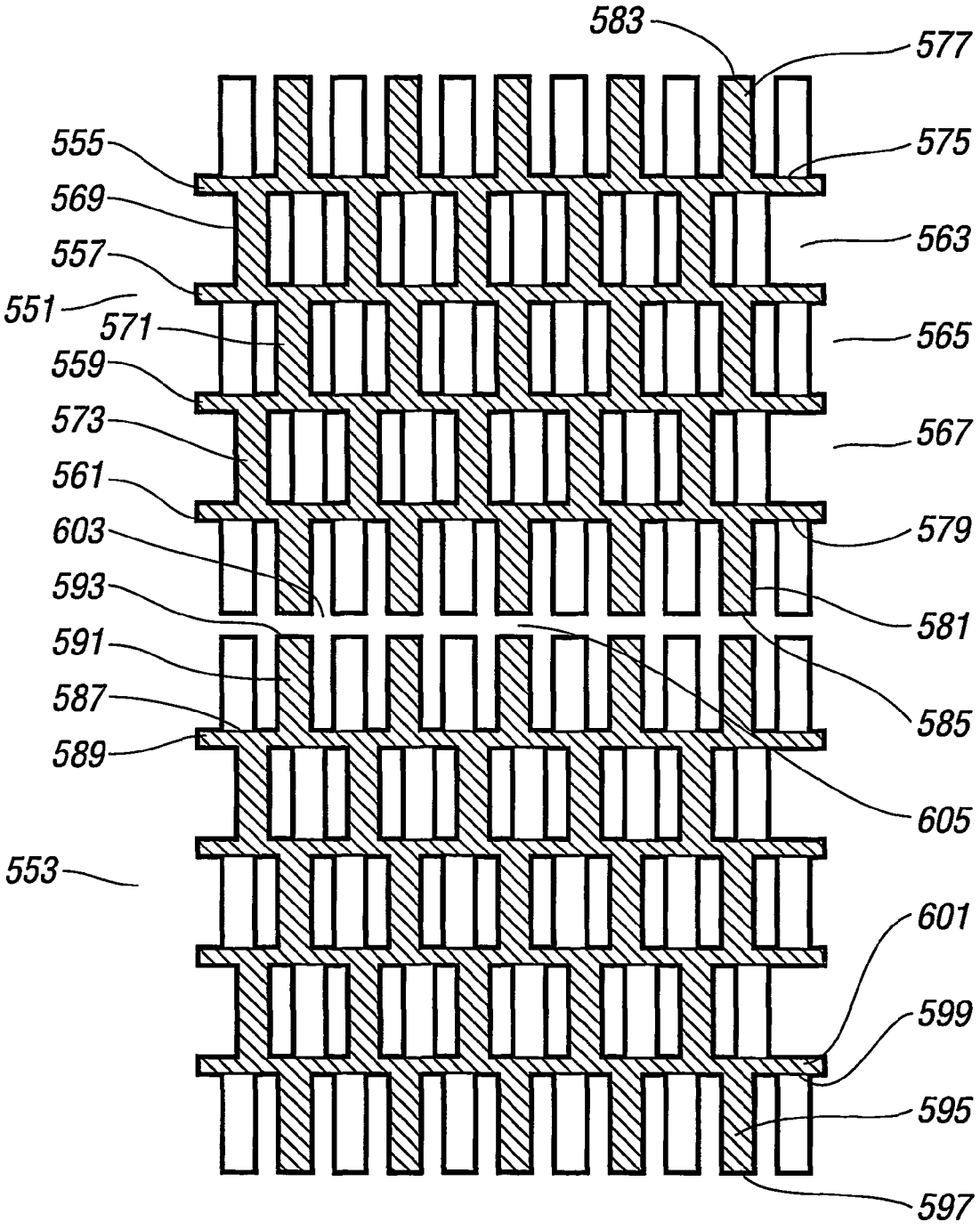
FIG. 16 shows a cross section through an embodiment of a heat exchanger according to the invention, having four plates per group and offset pins.

In the various embodiments described above, "cells" or groups of plates comprise respective plate pairs, the plates being bridged by pins which are either in-line or else offset. Moreover, in all the above embodiments, pins with free ends extend beyond the outermost heat transfer surfaces of the upper and lower plates in each pair. FIGS. 15 and 16 illustrate by way of cross-sectional views, heat exchangers with arrangements which differ from the aforementioned.

FIG. 15 shows a part of a cross-sectional view of a heat exchanger in which there are four plates in each group. For convenience, only two groups are shown, namely an upper pair 503 and a lower pair 505, separated by a gap 507 therebetween. The plates 509, 511, 513 and 515 of the upper group 503 are bridged by pins 517 etc, 519 etc, 521 etc, respectively for each of the gaps 523, 525 and 527 between the plates. Between one layer and the next, all these pins are in-line. However, no pins protrude from the upper surface 529 of the upper plate 509 of the upper group 503 nor from the lower surface 531 of the lower plate 515.

The structure of the lower group shown (505) is substantially the same with the pins 533 etc being in line between layers of that group, as well as in-line with those of the upper group 503.

Turning now to FIG. 16, again two groups only of the total number of groups of plates are shown for convenience. In this embodiment, again, there is an upper group 551 and a lower group 553, each group containing four parallel spaced apart plates. The plates of the upper groups are numbered 555, 557, 559 and 561. The gaps between the plates of the upper group are respectively labelled 563, 565 and 567. Adjacent plates in the upper group are bridged by respective pins 569 etc, 571 etc, 573 etc. In addition, from the upper surface 575 of the upper plate 555 extend pins 577 etc. From the lower surface 579 of the lower plate 561, extend pins 581 etc. Those pins extending from the upper surface 575 of the upper plate 555 and the lower surface 579 of the lower plate 561, terminate in respective free ends 583 etc, 585 etc.

The lower group of plates 553 is substantially identical to that of the upper group 551. Here, it can be seen that from an upper surface 587 of an upper plate 589 in the lower group, extend pins 591 etc terminating in respective free ends 593 etc. Similarly, pins 595 having free ends 597 etc extend from the lower surface 599 of the lower plate 601 of the lower group 553.

The upper and lower groups of plates are separated by a gap 603 and the free ends 585 etc of the lowerly extending pins 581 etc are spaced apart by a small division 605 from the upper free ends 593 etc of the pins 591 etc which extend upwardly from the upper surface 587 of the upper plate 589 of the lower group 553.

Within each group of the embodiment of FIG. 16, the pins are offset or staggered from one layer to the next defined by the spacings between the plates, in the manner of the embodiment described and illustrated with respect to FIGS. 13 and 14. The mutually facing pins 581 etc, 591, are nevertheless in-line with each other.

Variations of the described embodiments, as well as other embodiments all within the scope of the appended claims, will now become apparent to persons skilled in the art.

The invention claimed is:

1. A heat exchanger comprising:

a plurality of plates each having first and second heat transfer surfaces on reverse sides thereof, said plates being arranged in a stack with spacings between mutually facing heat transfer surfaces of adjacent plates, alternate spacings in the stack providing respectively, a first fluid path for a first fluid and a second fluid path for a second fluid, and wherein the plates are arranged in a plurality of groups, each comprising at least two plates;

a plurality of pins, wherein the pins are distinct from the plates until attachment therewith, and wherein the pins are arranged in mutually orthogonal rows and columns, and further wherein within at least one of the groups of plates:

first pins of the plurality thereof are arranged to bridge adjacent plates of the group, second pins of the plurality thereof extend from outermost heat transfer surfaces of the group, said second pins terminating in free ends at least some pins of the plurality thereof extend only from the first heat transfer surface of at least one plate in the group and are offset with respect to pins extending only from the second heat transfer surface of that plate.

2. A heat exchanger according to claim 1, wherein the groups of plates are arranged so that there is a gap between the free ends of the second pins extending from the outermost heat transfer surfaces of the one group and the free ends of the second pins extending from an outermost heat transfer surface of an adjacent group of plates.

3. A heat exchanger according to claim 1, wherein pins having mutually facing free ends are substantially in-line.

4. A heat exchanger according to claim 1, wherein pins that are offset from each other are welded or brazed to said plate.

5. A heat exchanger according to claim 1, wherein each group of plates consists of an even number of the plates.

6. A heat exchanger according to claim 1, wherein each group of plates consists of two of the plates.

7. A heat exchanger according to claim 1, wherein the first fluid path is connected to a source of first fluid to receive the first fluid therefrom and the second fluid path is connected to a source of second fluid to receive the second fluid therefrom.

8. A heat exchanger according to claim 7, wherein the pressure of the first fluid at its source is from 100% to 2000% of the pressure of the second fluid at its source.

9. A heat exchanger according to claim 1, wherein at least some of the pins are aligned in substantially uniformly spaced rows and the first and second fluids are directed to flow in substantially the same direction or substantially in counter direction in the respective first and second fluid paths.

10. A heat exchanger according to claim 9, wherein the rows are substantially perpendicular to the direction of flow of the first and second fluids.

11. A heat exchanger according to claim 9, wherein the rows are at an angle at from 45 to 85 relative to the direction of flow of the first and second fluids.

12. A heat exchanger according to claim 11, wherein the pins in alternate rows are respectively staggered relative to each other.

13. A heat exchanger according to claim 1, wherein at least some of the pins are substantially circular in cross-section.

14. A heat exchanger according to claim 13, wherein the ratio of average distance between pin centers to average pin diameter is from 1.25 to 4.0.

15. A heat exchanger according to claim 1, wherein at least some of the pins are provided with at least one surface feature for enhancing aerodynamic flow and/or heat transfer.

16. A heat exchanger according to claim 1, wherein the ratio of the mean spacing between plates defining the first fluid path in a central region of the exchanger to the mean spacing between plates defining the second fluid path in the same region is from 1: 10 to 100: 1.

17. A heat exchanger according to claim 1, wherein the width across the plates in a direction approximately or substantially orthogonal to the direction of flow of at least one of the first and second fluids, progressively narrows in a respective region approaching inflow of the first fluid and/or of the second fluid.

18. A heat exchanger according to claim 1, wherein inflow and/or outflow of one of the first and second fluids is directed through respective tube means passing through the stack of plates and provided with at least one opening into the respective first fluid path and/or second fluid path.

19. A heat exchanger according to claim 18, wherein inflow and/or outflow of said other of the first and second fluids is directed within a respective manifold wall at least partially surrounding the respective tube means.

20. A heat exchanger according to claim 1, wherein the plates are substantially flat.

21. A heat exchanger according to claim 1, wherein the plates are at least partially curved.

22. A heat exchanger according to claim 1, wherein the stack is substantially cubic.

23. A heat exchanger according to claim 1, wherein the plates are arranged radially.

24. A heat exchanger according to claim 16, wherein the ratio is from 1:10 to 10:1.

25. A heat exchanger according to claim 23, wherein the plates are arranged in involute form.

26. A heat exchanger according to claim 1, wherein pins that are offset from each other are laser welded to said plate.

27. A heat exchanger comprising:

a plurality of plates, wherein the plates are arranged in a plurality of groups, each group comprising first and second spaced-apart plates, the groups of plates arranged in a stack;

a first group of pins, a second group of pins, and a third group of pins, wherein the pins in the first, second, and third groups are distinct from the plates until attachment therewith, and further wherein:

(i) the first group of pins is disposed in a space between mutually facing surfaces of the first and second plates in each group, wherein one end of at least some of the pins are attached to one of the mutually facing surfaces and a second end of at least some of the pins are attached to the other of the mutually facing surfaces;

(ii) the second group of pins extends from and is attached to a non-facing surface of the first plate in each group;

(iii) the third group of pins extends from and is attached to a non-facing surface of the second plate in each group; and (iv) a longitudinal axis of symmetry of at least some of the pins in the first group thereof is offset from a longitudinal axis of symmetry of at least some of the pins of the second group thereof.

28. The heat exchanger according to claim 27 and further wherein the longitudinal axis of symmetry of at least some of the pins in the first group thereof is offset from a longitudinal axis of symmetry of at least some of the pins in the third group thereof.

29. The heat exchanger according to claim 27 wherein the longitudinal axis of symmetry of at least some of the pins in the second group thereof is in-line with a longitudinal axis of symmetry of at least some of the pins in the third group thereof.

30. A heat exchanger comprising:

a plurality of plates, wherein the plates are arranged in a plurality of groups, each group comprising first and second spaced-apart plates, the groups of plates arranged in a stack;

a plurality of groups of pins, wherein the pins are distinct from the plates until attachment therewith, and further wherein:

(i) a first group of pins is disposed in a space between mutually facing surfaces of the first and second plates in each group, wherein one end of each pin is attached to one of the mutually facing surfaces and a second end of each pin is attached to the other of the mutually facing surfaces;

(ii) a second group of pins extending from and attached to a non-facing surface of the first plate in each group;

(iii) a third group of pins extending from and attached to a non-facing surface of the second plate in each group;

(iv) a longitudinal axis of symmetry of at least some of the pins in the first group thereof is offset from a longitudinal axis of symmetry of at least some of the pins of the second group thereof; and (v) the second group of pins comprises pin sub-groups containing three nearest pins, wherein the longitudinal axes of symmetry of the three pins in at least some of the pin sub-groups are equidistantly spaced from one another.

31. The heat exchanger according to claim 30 and wherein the pins in the first group that are offset from the pins in the second group are attached to the first plate via laser welding.

32. The heat exchanger according to claim 30 wherein:

(vi) at least some of the pins in the first group thereof are arranged in mutually orthogonal rows and columns; and (vii) at least some of the pins in the second group thereof are arranged in mutually orthogonal rows and columns.

33. The heat exchanger according to claim 32 wherein:

(viii) neither columns nor rows of the first group of pins overlie respective columns or rows of the second group of pins.

34. A heat exchanger comprising:

a first plate, wherein the first plate includes a first pin-attaching region on a first side thereof, a second pin-attaching region on a second side thereof, and having no through-holes between the first side and the second side in the pin-attaching regions;

a first plurality of pins each having a first end terminating on the first pin-attaching region of the first plate and a plurality of first welds, the first welds resulting from welding at least some of the first plurality of pins to the first pin-attaching region;

a second plurality of pins each having a first end terminating on the second pin-attaching region of the first plate and a plurality of second welds, the second welds resulting from welding at least some of the second plurality of pins to the second pin-attaching region, wherein at least some of the pins of the first plurality thereof are axially offset from the pins of the second plurality thereof;

a second plate, wherein the second plate includes a third pin-attaching region on a first side thereof, a fourth pin-attaching region on a second side thereof, and having no through-holes between the first side and the second side in the pin-attaching regions thereof;

a third plurality of pins each having a first end terminating on the third pin-attaching region of the second plate and a plurality of third welds, the third welds resulting from welding at least some of the third plurality of pins to the third pin-attaching region; and a fourth plurality of pins each having a first end terminating on the fourth pin-attaching region of the second plate and a plurality of fourth welds, the fourth welds resulting from welding at least some of the fourth plurality of pins to the fourth pin-attaching region, wherein at least some of the pins of the third plurality thereof are axially offset from the pins of the fourth plurality thereof and are axially aligned with the pins of the second plurality thereof.

35. The heat exchanger of claim 34 and further comprising:

a third plate, wherein the third plate includes a fifth pin-attaching region on a first side thereof, a sixth pin-attaching region on a second side thereof, and having no through-holes between the first side and the second side in the pin-attaching regions thereof;

a fifth plurality of pins each having a first end terminating on the fifth pin-attaching region of the third plate and a plurality of fifth welds, the fifth welds resulting from welding at least some of the fifth plurality of pins to the fifth pin-attaching region;

a plurality of sixth welds on the third plate, the sixth welds resulting from welding the second end of the first plurality of pins to the sixth pin-attaching region, wherein at least some of the pins of the first plurality thereof are axially offset from the pins of the fifth plurality thereof;

a fourth plate, wherein the fourth plate includes a seventh pin-attaching region on a first side thereof, an eighth pin-attaching region on a second side thereof, and having no through-holes between the first side and the second side in the pin-attaching regions thereof;

a sixth plurality of pins each having a first end terminating on the eighth pin-attaching region of the fourth plate and a plurality of seventh welds, the seventh welds resulting from welding at least some of the sixth plurality of pins to the eighth pin-attaching region;

a plurality of eighth welds on the fourth plate, the eighth welds resulting from welding the second end of the fourth plurality of pins to the seventh pin-attaching region, wherein at least some of the pins of the fourth plurality thereof are axially offset from the pins of the sixth plurality thereof.

36. The heat exchanger of claim 34 and further wherein facing second ends of at least some of the pins in the second group and some of the pins in the third group are attached to one another.

* * * * *